United States Patent [19]

Dieterle et al.

[11] 4,366,871

[45] Jan. 4, 1983

[54] MOTOR-DRIVEN SCREWDRIVER

[75] Inventors: Herbert Dieterle, Ostfildern; Alfred Hettich; Karl Roll, both of Leinfelden, all of Fed. Rep. of Germany

[73] Assignee: Robert Bosch GmbH, Stuttgart, Fed. Rep. of Germany

[21] Appl. No.: 226,828

[22] Filed: Jan. 21, 1981

[30] Foreign Application Priority Data

Jan. 24, 1980 [DE] Fed. Rep. of Germany ..... 3002439

[51] Int. Cl.[3] ..... B25B 21/00

[52] U.S. Cl. ..... 173/163; 81/57.31

[58] Field of Search ..... 173/163; 81/57.31; 145/66

[56] References Cited

U.S. PATENT DOCUMENTS

| | | | |
|---|---|---|---|
| 1,762,515 | 6/1930 | Hiersch | 81/57.31 |
| 2,031,133 | 2/1936 | Schumann | 81/57.31 X |
| 2,721,591 | 10/1955 | Criswell | 81/57.31 X |
| 3,319,494 | 5/1967 | Ulbing | 81/57.31 X |
| 3,586,115 | 6/1971 | Amtsberg | 173/163 |
| 3,823,755 | 7/1974 | Sheffield | 81/57.31 |
| 3,942,398 | 3/1976 | Fletcher | 81/57.31 X |
| 4,147,219 | 4/1979 | Wallace | 173/163 |

*Primary Examiner*—Jimmy C. Peters

*Attorney, Agent, or Firm*—Michael J. Striker

[57] ABSTRACT

A screwdriver comprises a planetary gear carrier rotatably carrying a plurality of circumferentially displaced planet gears meshing with a pinion driven by the motor of the screwdriver and with teeth provided on the inner surface of a coupling element in form of a hollow cylinder surrounding the carrier. The coupling element is also provided at one end with coupling teeth axially displaced from the first-mentioned teeth. The coupling element is movable by a fluid-operated piston from a first position to which it is biased by springs, in which the coupling teeth thereon are in mesh with corresponding coupling teeth on the carrier to rotate with the same speed as the latter, to a second position in which the coupling teeth on the coupling element are in mesh with stationary teeth on a housing surrounding the carrier and the coupling element to hold the latter against rotation.

10 Claims, 2 Drawing Figures

MOTOR-DRIVEN SCREWDRIVER

BACKGROUND OF THE INVENTION

The present invention relates to a screwdriver with a drive motor having a drive shaft, a work shaft spaced from and coaxial with said drive shaft, a planetary gearing means between the drive shaft and the work shaft for driving the latter at different speeds of rotation and which for this purpose can be in a different manner coupled with the drive shaft and with means for controlling the coupling movement. Such a motor-driven screwdriver is known in the art and for instance disclosed in the German Auslegeschrift No. 25 26 004, in which, however, the changeover from turning the work spindle with a high rotational speed to a low rotational speed requires separate coupling elements. In addition, this changeover from high to low rotational speed of the work spindle can, in this known construction, only be carried out during turning of the drive shaft in clockwise direction, whereas during turning of the drive shaft in counterclockwise direction the work shaft can be driven only at high rotational speed.

SUMMARY OF THE INVENTION

It is an object of the present invention to provide a motor-driven screwdriver of the aforementioned kind which can be constructed with fewer parts than the screwdriver known in the art, and in which the step-down gearing formed by the planetary gear means can be used during rotation of the drive shaft in clockwise as well as in counterclockwise direction.

With these and other objects in view, which will become apparent as the description proceeds, the screwdriver according to the present invention mainly comprises a drive motor having a drive shaft, a work shaft spaced from and coaxial with the drive shaft, planetary gear means between the drive shaft and the work shaft for driving the latter at different speeds of rotation during rotation of the drive shaft at a constant speed, the planetary gear means comprising drive elements directly connected with the drive shaft for rotation therewith and a planetary gearing element constructed as a movable coupling element movable between a first position rotating with said drive elements and a second position in which it is prevented from rotation, and means connected to the coupling element for moving the same between the positions thereof.

By constructing one of the elements of the planetary gear means as a movable coupling element, the necessity of providing a separate additional coupling element is avoided, and the planetary gear means of the present invention is usable for rotating the work shaft in clockwise as well as counterclockwise directions. The screwdriver according to the present invention permits, therefore, turning of a screw at high speed with a small moment and tightening of the screw at low speed with a high moment.

An especially advantageous arrangement is obtained if the planetary gearing element serving as a coupling element is constructed as the hollow gear of the planetary drive which is movable in axial direction and the internal gear teeth thereof form at the same time the coupling element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
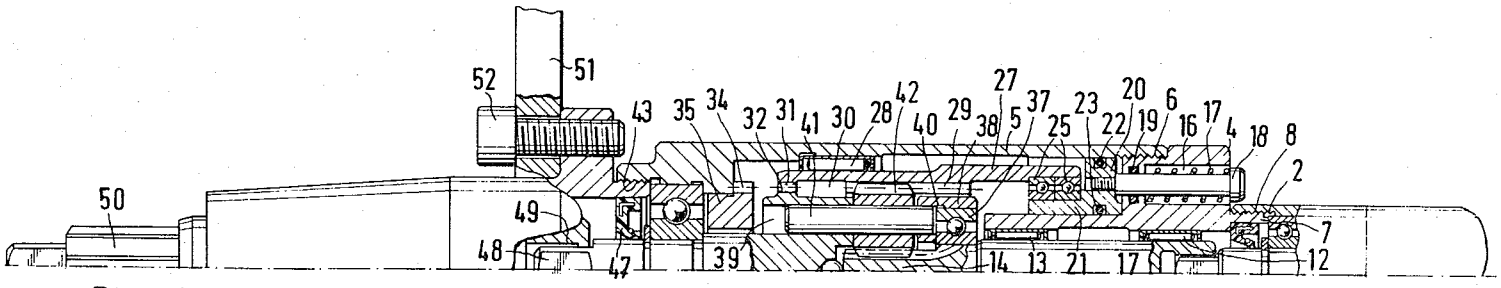
FIG. 1 is a partially sectioned side view of the upper half of the screwdriver according to the present invention and showing the various elements thereof in a position in which a direct drive is provided between the drive shaft and the work shaft.

Referring now to the drawing, it will be seen that the screwdriver according to the present invention comprises a drive motor 1 provided at one end with an internal thread 2 and a drive shaft 3 projecting beyond this one end of the drive motor 1. A head member 4 of a housing 5 is readily connected to the latter by means of a screwthread 6. The head member 4 is provided at one end thereof with a socket 7 having an outer screwthread 8 threadingly connected with the inner screwthread 2 of the motor 1. The drive shaft 3 is provided at the free end thereof with a coupling trunnion 9 which engages into a corresponding coupling sleeve 10 at the end of an intermediate shaft 11. The intermediate shaft 11 is mounted for rotation in ball bearings 12 and 13 and forms at the end thereof opposite the coupling sleeve 10 a pinion 14. The needle bearings 12 and 13 are seated in a coaxial bore 15 in the head member 4. The head member 4 is first provided with three stepped bores 16 circumferentially spaced through 120° extending parallel to the axis thereof from the end of the head member facing the motor 1 into the latter. Coiled compression springs 17 are respectively arranged in the large-diameter portion of the stepped bores 16. The shafts of bolts 18 extend through the coil springs 17 and through the smaller-diameter portions of the bores 16. Each of the bolts 18 has a head of a diameter slightly smaller than the large diameter of the stepped bores 16, and the coil compression springs 17 abut with opposite ends respectively against the heads of the bolts 18 and the shoulder formed at the inner ends of the large-diameter portions of the bores 16. Sealing rings 19 are respectively arranged in the small-diameter portions of the bores to seal the shafts of the bolts 18 air-tightly toward the outer atmosphere.

The bolts 18 form at the inner ends threaded pins 20 which are screwed into correspondingly threaded bores of an annular piston 21. The annular piston 21 is guided at its inner surface on the outer surface of a reduced cylindrical portion of the head member 4, and at its outer surface in a cylinder bore formed by the inner surface of the housing 5. Sealing rings 22 and 23 are respectively provided in annular grooves at the inner and outer surface of the annular piston. The head member 4 is further provided with a connecting bore 24 for connecting a pressure fluid conduit thereto, and the bore 24 communicates at the inner end thereof with the space between the head member 4 and the piston 21. A pair of ball bearings 25 are mounted on a reduced-diameter portion of the piston 21. These ball bearings are received in a cylindrical cut-out 26 of a hollow cylinder 27. The hollow cylinder 27 is turnably mounted by means of a needle bearing 28 in the housing 5. The hollow cylinder 27 is provided with an internal gearing 29 which are cut away at 30 and which form at the outer end of the hollow cylinder 27 coupling teeth 31. These coupling teeth 31 are alternately engageable with corresponding coupling teeth 32 of a planetary gear carrier 3 and corresponding coupling teeth 34 on a bushing 35 stationarily pressed into a corresponding bore of the housing 5. The planet gear carrier 33 forms a shaft which an enlarged head portion and is turnably mounted by means of a ball bearing 36 located in a corresponding portion of the cylindrical housing 5. The intermediate shaft 11 carries a ball bearing 37 on which a supporting ring 38 is mounted. Three bores 39 circumferentially spaced through 120° extending parallel to the axis of the planet gear carrier 33 are provided in the enlarged portion of the planetary gear carrier 38 and corresponding bores 40 aligned therewith are provided in the supporting ring 38. Bolts 41 are respectively mounted in the aligned bores 39 and 40. The bolts 41 turnably carry three planet gears 42, the teeth of which mesh with the teeth of the pinion 40 as well as with the teeth of the internal gearing 29 of the hollow cylinder 27. The end of the housing 5 opposite the motor 1 is provided with an inner screwthread threadingly connected with the outer screwthread 44 of a socket 45 on a work spindle housing 46. A seal 47 seals the work spindle housing 46 with respect to the housing 5. The shaft end of the planet gear carrier 33 projecting beyond the housing 5 has a coupling trunnion 48 which projects into a fitting coupling sleeve 49 of a work spindle 50. The work spindle housing 46 rotatably mounting the work spindle 50 is connected to a carrier 51 by means of screws 52.

Figure 2:
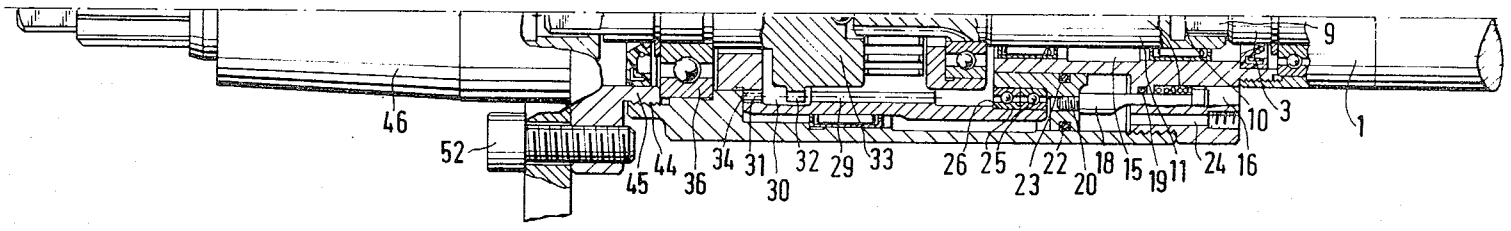
FIG. 2 is a partially sectioned view of the lower half of the screwdriver, in which the planetary gearing is connected as a step-down gearing between the drive shaft and the work shaft.

In the position of the various elements as illustrated in FIG. 1, the coil compression springs 17 press the piston 21 into abutment with the head member 4 and hold the piston in this position. Thereby, the hollow cylinder 27 is moved by the ball bearings 25 likewise to a position in which the coupling teeth 31 mesh with the coupling teeth 32 of the planet gear carrier 33. The drive of the drive shaft 3 is then transmitted over the intermediate shaft 11, the pinion 14 thereon, and the planet gears 42, onto the planet gear carrier 33 and from the latter onto the work spindle 50. Since the hollow cylinder 27 and the planet gear carrier 3 are coupled with each other so that they cannot turn with respect to each other, the planet gears 42 can also not turn about the bolts 41. The gear teeth act in this position of the various members only as rigid entrainment means. No relative turning of the drive elements carrying teeth takes place in this position of the various members. The work shaft 50 is therefore rotated with the speed of the drive shaft 3. After a screw connected to the work spindle has thus been driven in by rotation of the latter, and the screw has then to be tightened, the various elements of the screwdriver have to be shifted from the position shown in FIG. 1 to that shown in FIG. 2. For this purpose, a pressure fluid, preferably air, is fed through the connecting bore 24. The pressure fluid displaces the piston 21 towards the left, as viewed in the drawing, to the position shown in FIG. 2. In the position shown in FIG. 2, the coupling teeth 31 of the hollow cylinder 27 engage with the coupling teeth 34 of the stationary bushing 35. Thereby, the hollow cylinder 27 is prevented from rotation. The drive from the drive shaft 3 is now first transmitted to the intermediate shaft 11. The pinion 14 thereon drives now the planet gears 42, which roll on the internal gearing 29 of the now stationarily held hollow cylinder 27 to thereby take along over the bolts 41 the planet gear carrier 33. This will result in a reduction of the rotational speed of the work shaft 50 as compared to the rotational speed of the drive shaft 3. The work shaft 50 rotates therefore slower than the drive shaft 3, but with a higher turning moment, so as to tighten a screw engaged by the work shaft 50. The internal gearing 29 and the coupling teeth 31 of the hollow cylinder 27 preferably are formed in a single operation by broaching. The construction of the teeth of the planetary gear means requires, for the operation of the screwdriver according to the present invention in clockwise or counterclockwise direction, no special teeth configuration. Of course, the motor 1 has to be constructed as a reversible motor. In order to return the piston 21 and therewith the hollow cylinder 27 to the position as shown in FIG. 1, it is only necessary to vent the space between the piston 21 and the head member 4. The coil compression springs 17 then move, via the bolts 18, the piston 21 back to the position shown in FIG. 1. The described means for moving the piston 21 between the two positions thereof makes the screwdriver according to the present invention especially suitable for use in a multiple screwdriver system in which all screwdrivers may synchronously be switched over from one to the other position thereof in a simple manner.

It will be understood that each of the elements described above, or two or more together, may also find a useful application in other types of screwdrivers differing from the types described above.

While the invention has been illustrated and described as embodied in a motor-driven screwdriver selectively operable at high speed with a low moment and at low speed with a high moment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A screwdriver comprising a drive motor having a drive shaft and a work shaft spaced from and coaxial with said drive shaft; planetary gear means between said drive shaft and said work shaft for driving the latter at different speeds of rotation during rotation of said drive shaft at a constant speed, said planetary gear means comprising drive elements directly connected with said drive shaft for rotation therewith and a planetary gearing element constructed as a movable coupling element movable between a first position rotating with said drive elements and a second position in which it is prevented from rotation; and means connected to said coupling element for moving the same between said positions thereof.

2. A screwdriver as defined in claim 1, wherein said planetary gearing element constructed as a movable coupling element is in the form of a hollow cylinder surrounding said drive elements of said planetary gear means.

3. A screwdriver as defined in claim 1, wherein said coupling element is axially movable between said positions thereof, and wherein said means for moving said coupling element between said positions thereof comprises a fluid-operated piston connected to said coupling element.

4. A screwdriver as defined in claim 3, and including spring means biasing said piston and said coupling element connected thereto to a position in which said coupling element is in said second position.

5. A screwdriver as defined in claim 3, wherein said hollow cylinder constituting said coupling element is provided at the inner surface thereof with gear teeth and coupling teeth axially displaced from said gear teeth, and wherein said drive elements directly connected with said drive shaft comprise an intermediate shaft coupling at one end with said drive shaft and forming at the other end a pinion, a planet gear carrier provided at one end thereof with coupling teeth, a plurality of circumferentially displaced planet gears rotatably carried by said planet gear carrier, meshing with said pinion and also meshing with said gear teeth of said coupling element, said coupling teeth of said coupling element and said coupling teeth on said planetary gear carrier being arranged to mesh with each other in said first position of said coupling element.

6. A screwdriver as defined in claim 5, and including a housing surrounding said planetary gear means and provided with stationary coupling means arranged for meshing with said coupling teeth on said hollow cylinder constituting said coupling element when the latter is in said second position, thereby preventing said coupling element from rotation.

7. A screwdriver as defined in claim 6, wherein said planetary gear means forms part of an independent unit.

8. A screwdriver as defined in claim 7, wherein said independent unit further includes said housing and a head member mounted on one end of said housing.

9. A screwdriver as defined in claim 8, and including a work shaft housing turnably mounting said work shaft, said independent unit being threadingly connected at said one end with said drive motor and at the other end threadingly connected with said work shaft housing.

10. A screwdriver as defined in claim 8, wherein said head member is provided with a plurality of circumferentially spaced stepped bores parallel to said drive shaft and including a plurality of bolts slidably guided in said bores and connected at inner ends to said piston, and a coil compression spring about each of said bolts for biasing the respective bolt in axially outward direction.

* * * * *